US009756921B2

(12) United States Patent
Bergman

(10) Patent No.: US 9,756,921 B2
(45) Date of Patent: Sep. 12, 2017

(54) COMBINATION BEACH MAT AND EXERCISE MAT CARRYING BAG

(71) Applicant: Cameron Bergman, Vancouver (CA)

(72) Inventor: Cameron Bergman, Vancouver (CA)

( * ) Notice: Subject to any disclaimer, the term of this patent is extended or adjusted under 35 U.S.C. 154(b) by 0 days.

(21) Appl. No.: 15/210,768

(22) Filed: Jul. 14, 2016

(65) Prior Publication Data

US 2017/0013946 A1 Jan. 19, 2017

Related U.S. Application Data

(60) Provisional application No. 62/192,249, filed on Jul. 14, 2015.

(51) Int. Cl.
*A45C 13/30* (2006.01)
*A45C 13/10* (2006.01)
*A45C 9/00* (2006.01)

(52) U.S. Cl.
CPC ..... *A45C 13/30* (2013.01); *A45C 9/00* (2013.01); *A45C 13/103* (2013.01); *A45C 13/1076* (2013.01); *A45C 2009/007* (2013.01)

(58) Field of Classification Search
CPC ..... A45F 3/02; A45C 11/24; A45C 13/103; A45C 13/1076; A45C 13/30
See application file for complete search history.

(56) References Cited

U.S. PATENT DOCUMENTS 4,164,275 A * 8/1979 Davis ..... A45C 9/00 190/2
4,188,988 A * 2/1980 Agyagos ..... A45C 9/00 190/2
4,222,468 A * 9/1980 De Fries ..... A45C 9/00 190/102
4,231,125 A 11/1980 Tittl
4,546,507 A 10/1985 Weinstein
4,841,587 A 6/1989 Carter et al.
4,970,741 A * 11/1990 Spina ..... A45C 3/10 190/2
5,022,107 A 6/1991 Knotts
5,081,727 A * 1/1992 Ippolito ..... A47G 9/062 5/417
5,163,192 A 11/1992 Watson
D336,199 S 6/1993 Bazata, Jr.
5,361,435 A * 11/1994 Reeves ..... A45C 3/10 5/419

(Continued)

*Primary Examiner* — Corey Skurdal

(57) ABSTRACT

A combination beach mat and carrying bag comprising a cylindrical pocket member having a cylindrical cavity and closed and open ends and adapted to receive an exercise mat in a rolled configuration, the open end having a movable closure panel to enclose the cavity and a releasable fastener to enable the opening and closing of the closure member, an elongate fabric member having a first end connected to the pocket member along a longitudinal edge, wherein the fabric member may be rolled around the pocket member to provide a cylindrical compact configuration, a fastening means situated at the second end of the fabric member and on a corresponding portion of the bottom surface when in the compact configuration to releasably secure the second end to the bottom surface for maintaining the carrying bag in the compact configuration, and a carrying strap affixed to each end of the pocket member.

13 Claims, 20 Drawing Sheets

(56) References Cited

U.S. PATENT DOCUMENTS

| | | | | | |
|---|---|---|---|---|---|
| 5,435,025 | A | * | 7/1995 | Gerard | A47G 9/062 5/417 |
| D391,109 | S | * | 2/1998 | Miller | D6/596 |
| 5,730,529 | A | | 3/1998 | Fritz et al. | |
| 6,182,309 | B1 | | 2/2001 | Sullivan | |
| 6,751,816 | B1 | | 6/2004 | Wechsler | |
| 6,952,845 | B1 | | 10/2005 | Akkad | |
| 7,225,483 | B1 | | 6/2007 | Remblad | |
| D578,800 | S | * | 10/2008 | Bass | D6/386 |
| D586,554 | S | * | 2/2009 | Baptiste | D3/233 |
| 2007/0113338 | A1 | | 5/2007 | Remblad | |
| 2007/0157382 | A1 | | 7/2007 | Reeves | |

* cited by examiner

COMBINATION BEACH MAT AND EXERCISE MAT CARRYING BAG

BACKGROUND OF THE INVENTION

1. Field of Invention

The present invention pertains to leisure accessories for beach, pool, and vacation situations, and more particularly pertains to a portable, lightweight, combination beach mat and exercise mat carrying bag.

2. Description of Related Art

Exercise mats of the roll up variety are known in the art and are widely used in floor exercise such as yoga. Carrying bags for such mats are also available, which may comprise a cylindrical pocket configured to receive a rolled up exercise mat there within and having a closed end and a zippered open end. Such carrying bags may also include a shoulder strap.

Generally, individuals who use exercise mats are typically fit and also go to the beach or swimming pool as a leisure activity. At the beach or pool, it is often common to see people laying prone upon a beach towel, whether it be on the concrete edge of a pool, a grassy area or on the sand. Many beach or pool-goers that enjoy reading or observing of the surroundings attempt to elevate their head by resting it upon a beach bag, a towel, or other bulky item. Accordingly, it would be advantageous to have a roll up beach mat with a convenient headrest to provide comfort to users.

SUMMARY OF THE INVENTION

In some aspects, the present invention provides a rollup beach mat with a built in head rest pocket that also acts as storage for rollup exercise mats, which provide the head rest cushioning for the apparatus. Alternatively, a foam bolster may be inserted into the head rest pocket for providing the cushion for the head rest.

In some aspects the present invention provides a combination beach mat and exercise mat carrying bag comprising: a cylindrical pocket member having a closed end and an open end, and defining an outer surface and a cylindrical cavity adapted to receive an exercise mat in a rolled configuration, the open end of the pocket member having a movable closure panel to selectively enclose the cavity and a releasable fastening member cooperating with the open end and the closure panel to releasably secure the closure panel to the open end of the pocket member; an elongate fabric member having opposing first and second ends, opposing sides, and a top and bottom surface, the first end of the fabric member being connected to the pocket member along a longitudinal edge of the outer surface, wherein the fabric member may be rolled around the pocket member to provide a cylindrical compact configuration; a fastening means situated at the second end of the fabric member and on a corresponding portion of the bottom surface when in the compact configuration to releasably secure the second end to the bottom surface for maintaining the carrying bag in the compact configuration; and a carrying strap affixed to each end of the pocket member allowing the carrying bag to be easily transported.

In some embodiments, the pocket member may be shape retaining resilient such that the pocket member yields to deformation upon an application of force but returns to its cylindrical shape in the absence of the force.

In some embodiments, the releasable fastening member may be a zipper on a circumference of the closure member and a corresponding edge on the open end of the pocket member.

In some embodiments, the shape retaining resilience may be provided a thin foam cylinder secured within the cavity of the pocket member such that the pocket member and foam cylinder combination yields to deformation upon an application of force but returns to a cylindrical shape in the absence of the force.

In some embodiments, the fabric member may comprise one or more panels of material that define a rectangular shape having a width substantially equal to the width of the pocket member, and a length of about between 3 ft.-8 ft. In some embodiments, the fabric member may comprise one or more panels of material that define a rectangular shape having a width substantially equal to the width of the pocket member, and a length sufficient to extend beyond the feet of a person of average height reclined on the device with the person's head resting on the pocket member.

In some embodiments, the fabric member may further include on the top surface a planar second pocket extending substantially across a width of the fabric member and configured to receive a folded towel or cloth therein. In some embodiments, the second pocket may be situated adjacent the second end of the fabric member.

In some embodiments, the fastening means may comprise a plurality of button snap fasteners on the top surface adjacent the second end and at complementary locations on the bottom surface.

In some embodiments, the fastening means may comprise a plurality of side release buckles adjacent the second end and at complementary locations on the bottom surface.

In some embodiments, a removable foam insert may be included within the cavity of the pocket member. In some embodiments, the foam insert may define a longitudinal cavity sized to receive one or more beverage containers therein to thermally insulate the one or more beverage containers from the atmosphere.

In some embodiments, a closeable third pocket may be included at the closed end of the pocket member and sized to correspond with a circumference of the pocket member at the closed end.

In some embodiments, a closeable fourth pocket may be included on the bottom surface sufficiently proximate to the second end such that the fourth pocket remains exposed with the fabric member being rolled onto the pocket member.

Other aspects and features of the present invention will become apparent to those of ordinary skill in the art upon review of the following description of embodiments of the invention in conjunction with the accompanying figures.

BRIEF DESCRIPTION OF THE DRAWINGS

In drawings which illustrate by way of example only embodiments of the invention.

DETAILED DESCRIPTION

Figure 1:
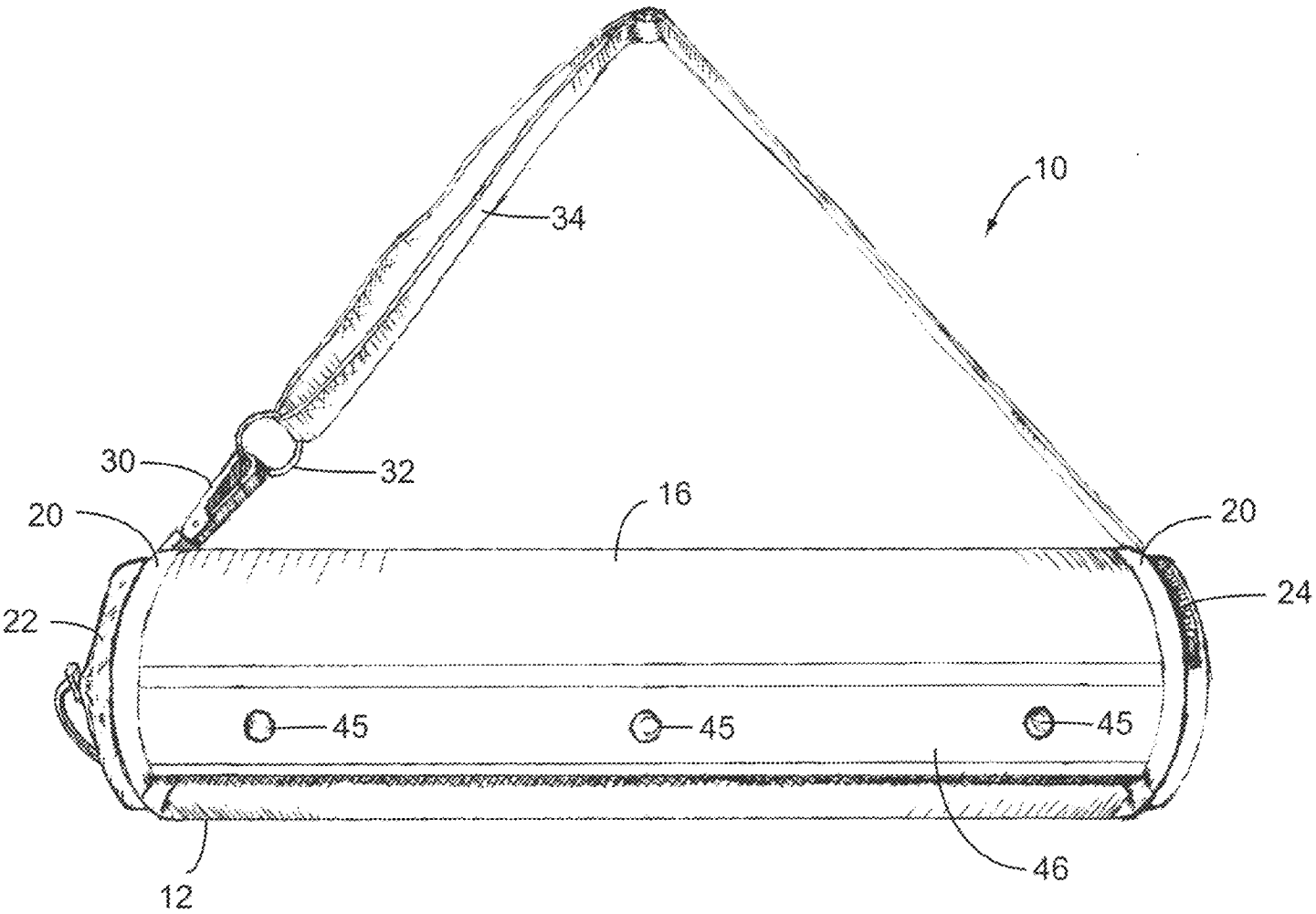
FIG. 1 is a front view of a combination beach mat and exercise mat carrying bag according to an embodiment of the invention.

Referring to FIGS. 1-6, a combination beach mat and exercise mat carrying bag according to an embodiment of the invention is shown generally at 10. The device 10 includes a cylindrical pocket member or pocket 12 that is attached along a longitudinal edge 14 to a fabric member such as mat portion 16. Preferably, the pocket 12 and the mat portion 16 are made of a fabric material, and preferably a material that is comfortable, durable, and water resistant.

The pocket 12 is configured to receive within its cavity a rolled up exercise mat 18, such as a yoga mat. Alternatively, a tubular foam bolster (not shown) may be used in place of a rolled up exercise mat for provided a cushion to the pocket 12. Accordingly, the cylindrical pocket 12 and an exercise mat 18 or foam bolster received within it provides a head or neck support to a user who reclines on the device.

The pocket 12 includes trim 20 on both ends to help maintain the cylindrical shape of the pocket when it is empty, which eases the insertion of an exercise mat 18 or foam bolster into the pocket 12.

At an open end of the pocket 12 is provided a draw string closure 22 that is configured to completely close off the end for retaining exercise mat 18 there within in a closed configuration, and to completely open to the circumference of the cylindrical pocket to allow the insertion and withdrawal of exercise mat 18 or foam bolster. The opposite end of the cylindrical pocket 12 is closed with a circular end panel of fabric (not shown). A zippered accessory pocket 24 is provided at the closed end for storage of keys, phone, wallets and other small items. As well, a mesh pocket 26 with an elasticized opening 28 is provided on the outside of zippered pocket 24 for the storage of other items. Both zippered pocket 24 and mesh pocket 26 are configured to face open side upwards when the beach mat 10 is unrolled and rolled up in carrying position.

Figure 9:
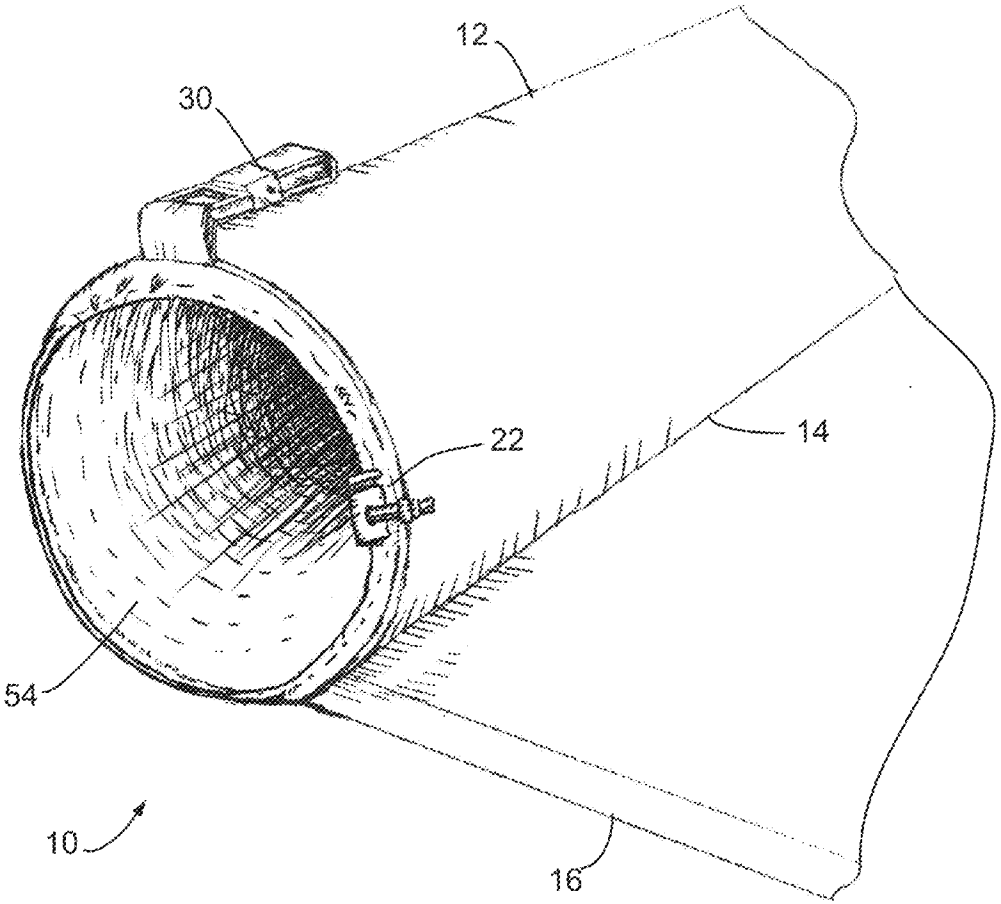
FIG. 9 is a left perspective view of the embodiment in FIG. 1 further including a thin foam cylinder.
Figure 10:
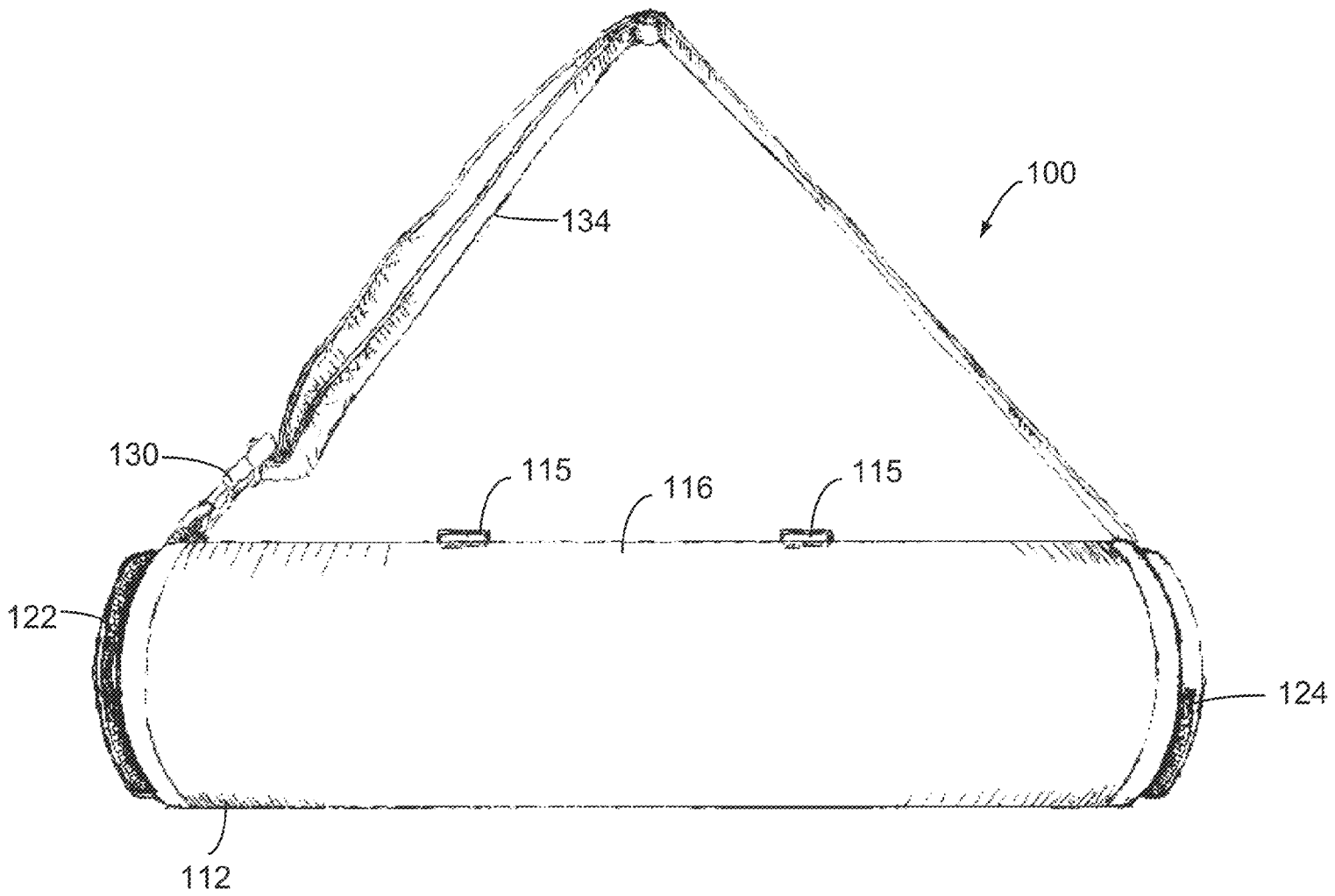
FIG. 10 is a front view of a combination beach mat and exercise mat carrying bag according to another embodiment of the invention.
Figure 11:
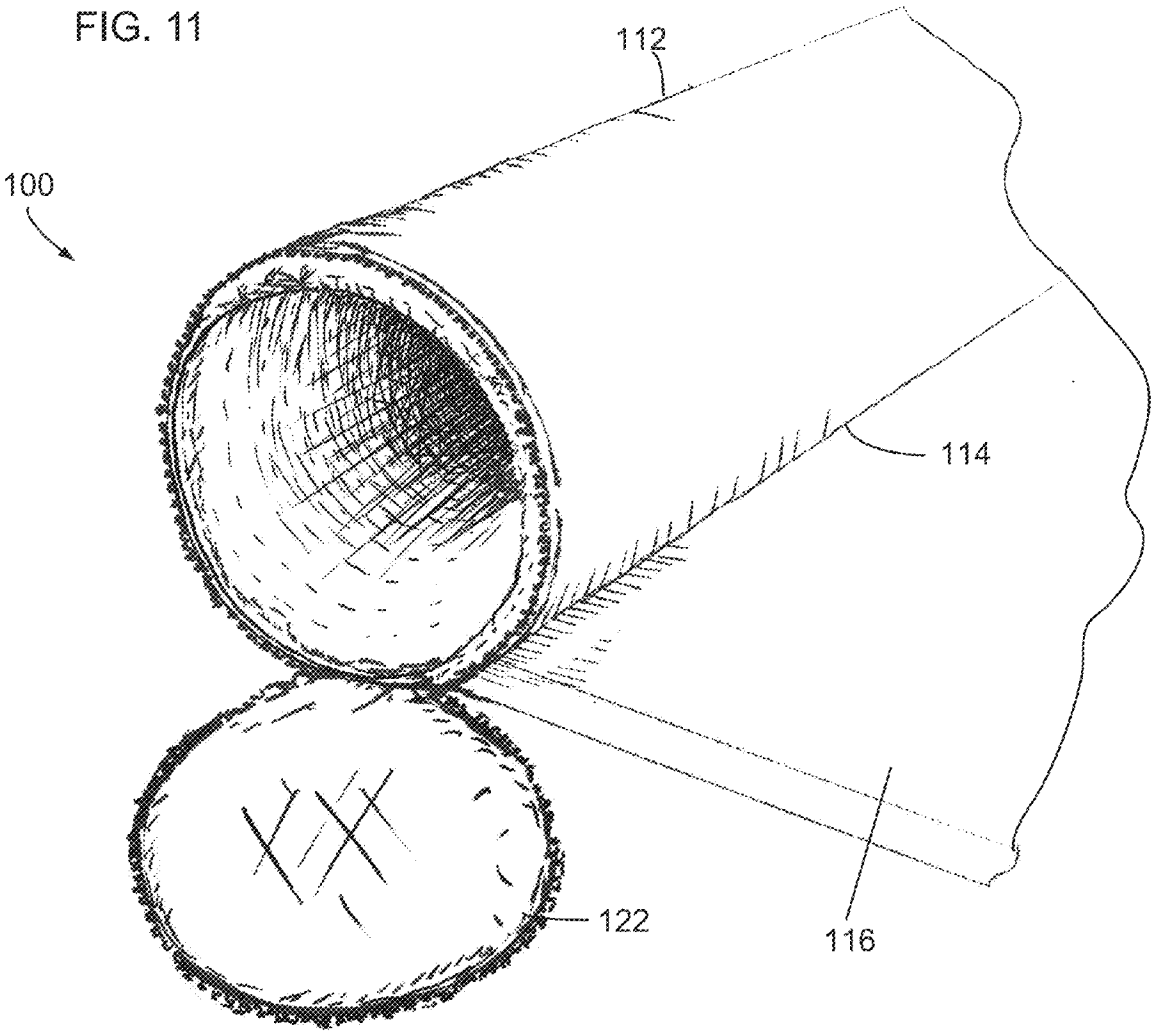
FIG. 11 is a left perspective view of the embodiment in FIG. 10.
Figure 12:
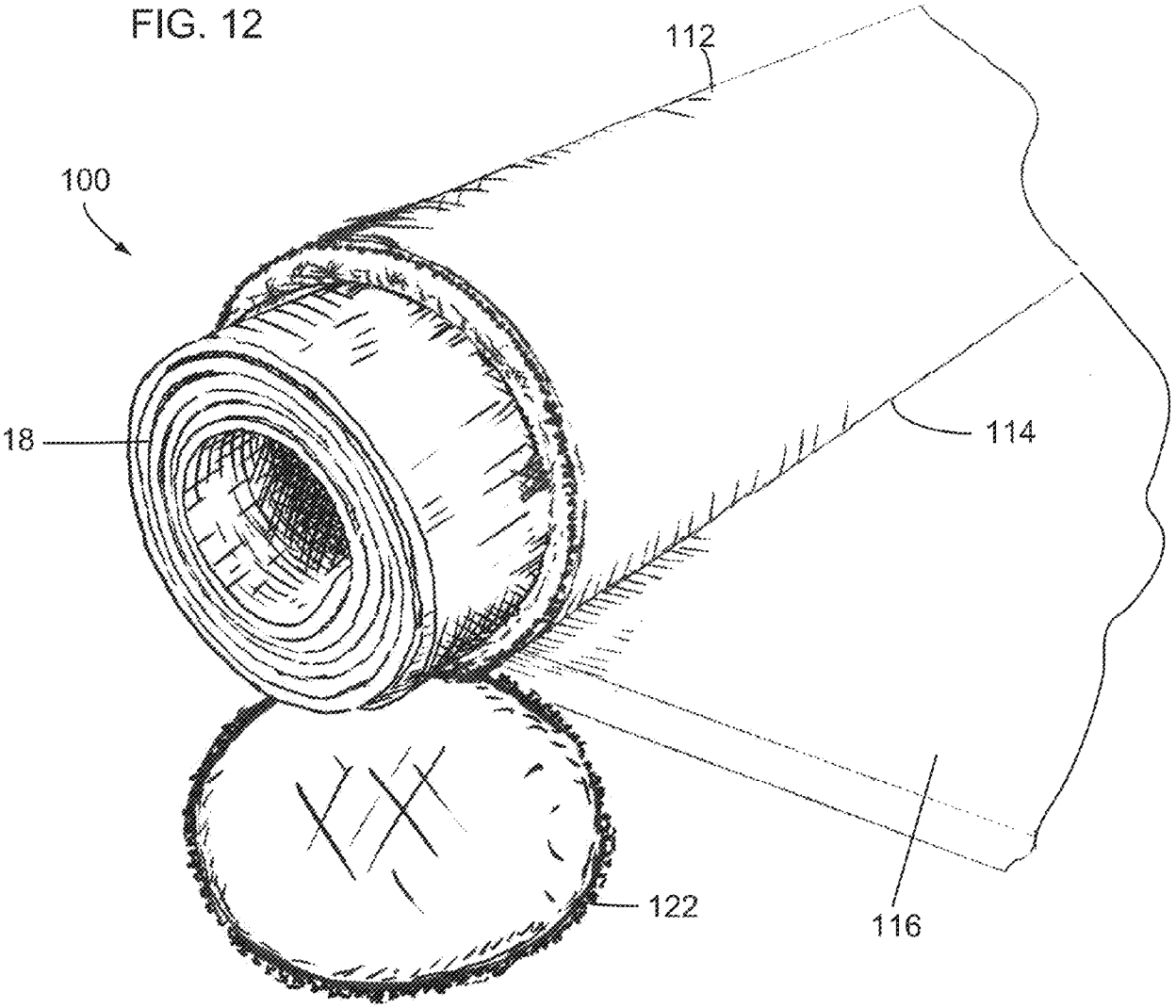
FIG. 12 is a left perspective view of the embodiment in FIG. 10 shown with a rolled up exercise mat.
Figure 13:
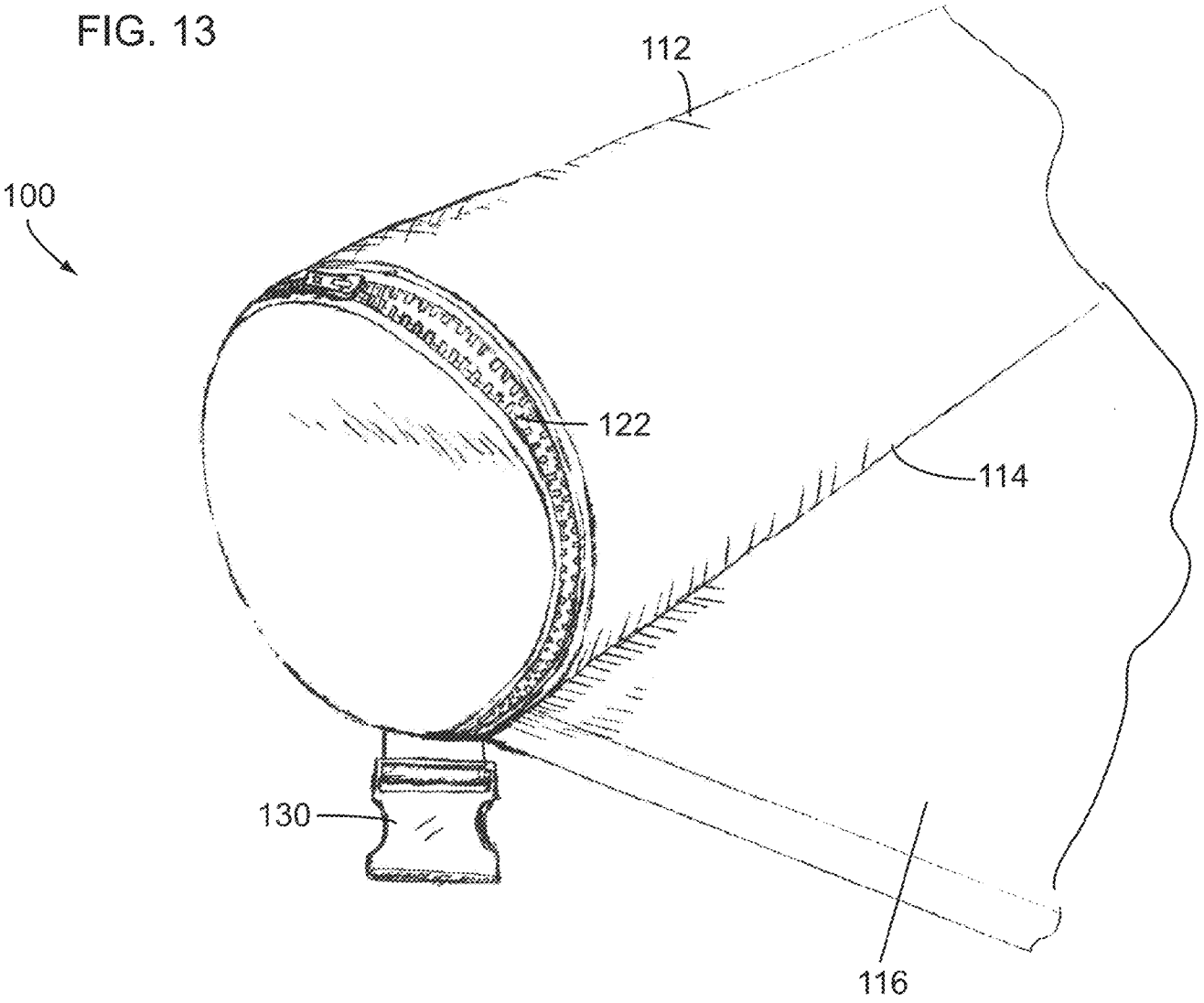
FIG. 13 is a left perspective view of the embodiment in FIG. 10.
Figure 14:
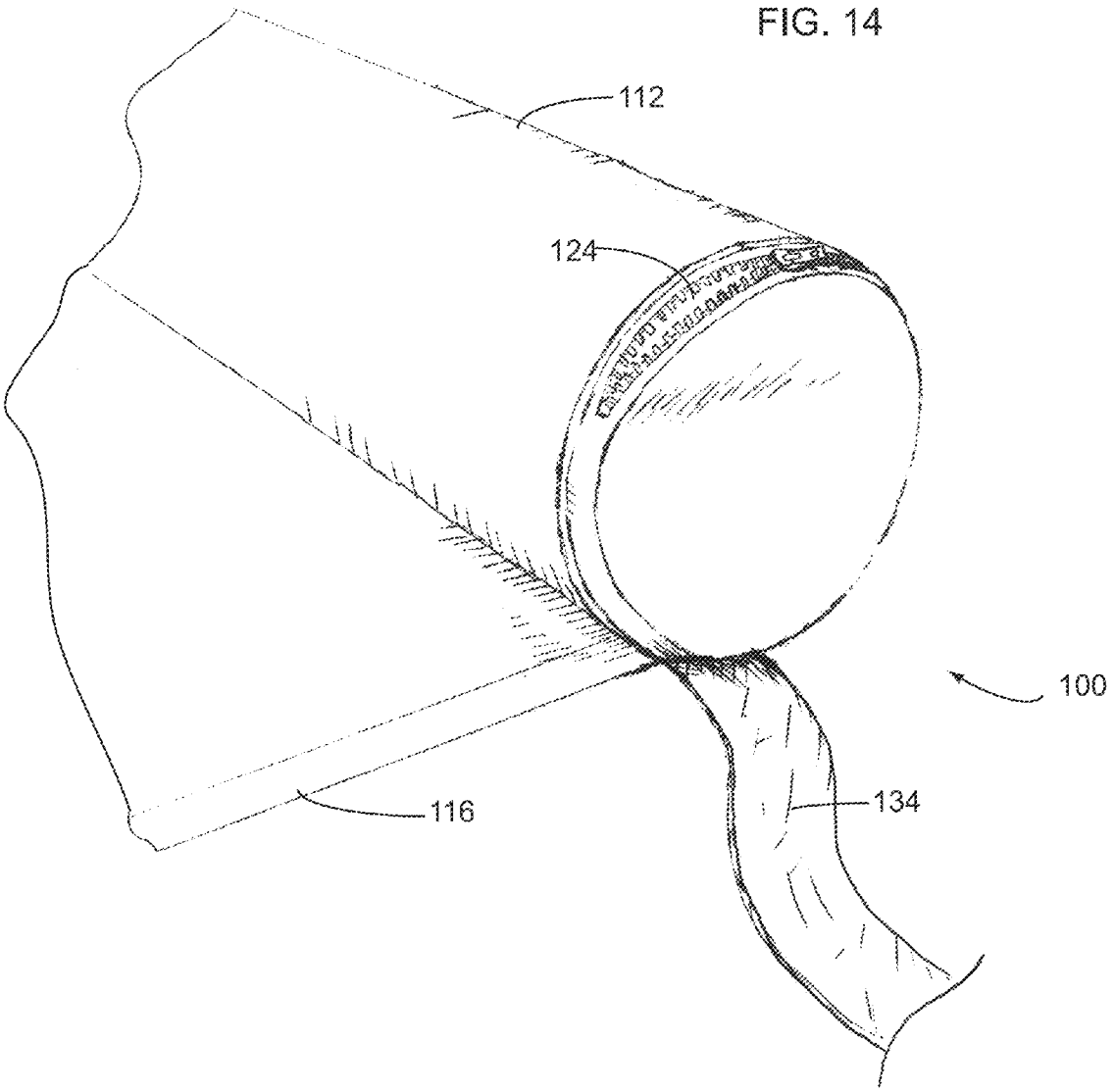
FIG. 14 is a right perspective view of the embodiment in FIG. 10.

Referring to FIG. 9, in some embodiments, it may be preferable to include a thin foam cylinder 54 that is sewn or secured into the cylindrical pocket 12 to provide additional shape to the pocket 12 when empty. The thin foam cylinder 54 acts as a framework to keep the cylindrical shape when pocket 12 is not being used as storage, and allow for ease of insertion or withdrawal of a rolled up mat 18 or foam bolster from the pocket 12. The thin cylinder has an inside diameter large enough to accommodate a rolled up mat 18 or foam bolster, and allow easy usage of draw string closure 22.

The pocket 12 also includes a releasable hook 30 to which is attached a ring 32 of a shoulder strap 34. The other end of the shoulder strap is attached to the opposite end of the pocket adjacent the zippered pocket 24. Hence the end of the shoulder strap 34 adjacent the hook 30 may be released from the device 10, and it may be conveniently folded and stored within the mesh pocket 26. The adjustable and detachable carrying strap gives a wider base and distributes the bag in a more balanced way that allows for multiple comfortable carrying positions, compared to carrying straps that are attached at narrower angle, and it can be easily adjusted for comfort.

Figure 5:
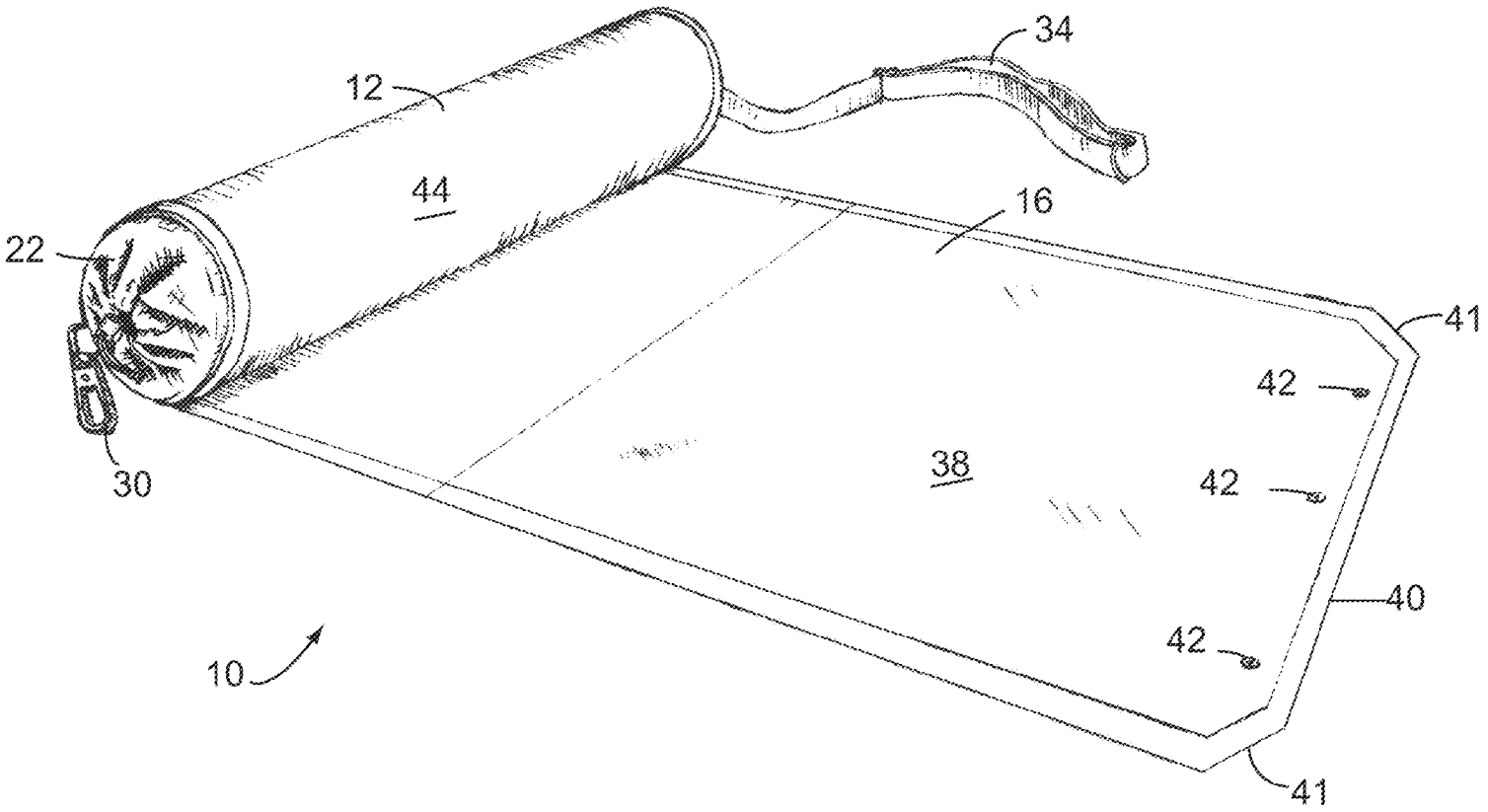
FIG. 5 is a left perspective view of the embodiment in FIG. 1 shown partially unrolled.
Figure 6:
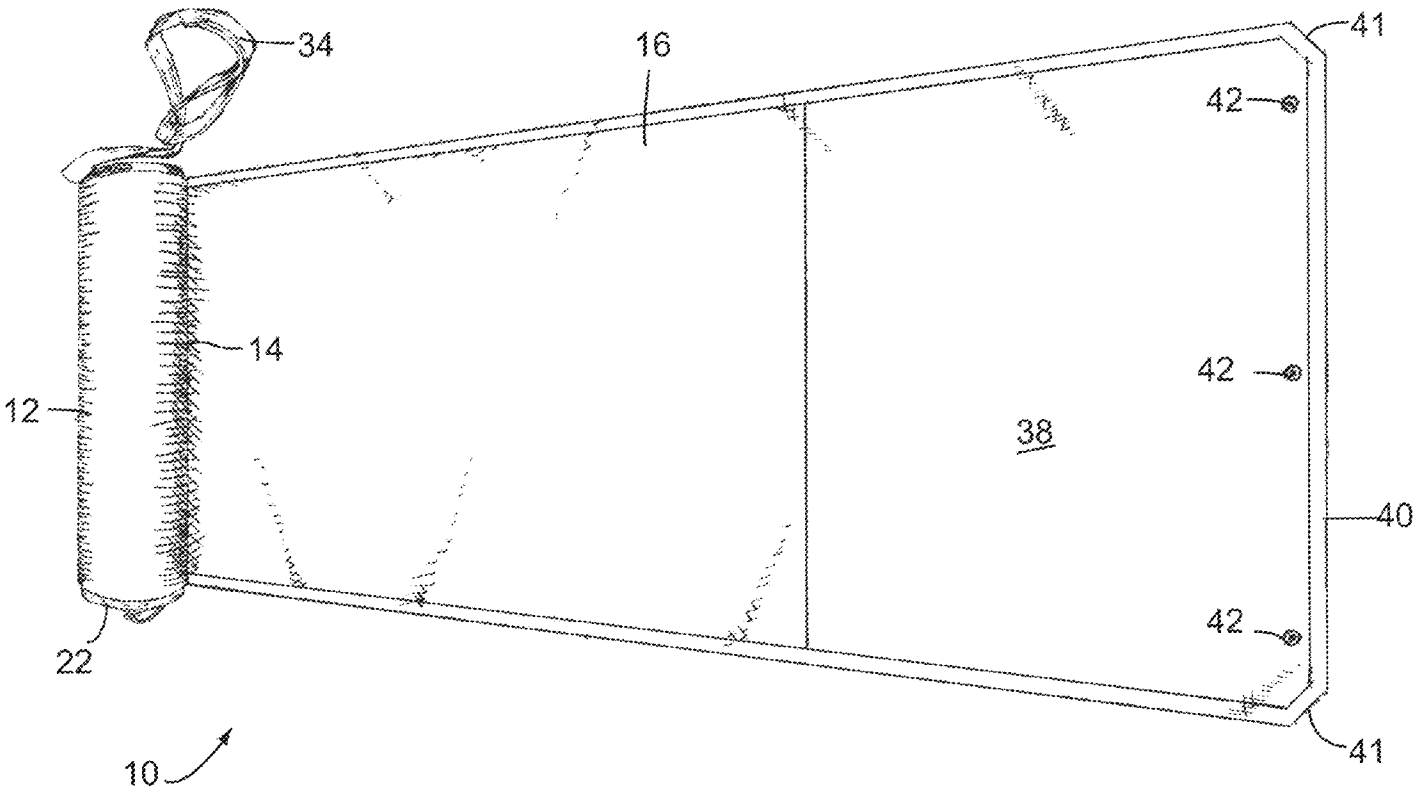
FIG. 6 is a top perspective view of the embodiment in FIG. 1 shown completely unrolled.

Referring to FIGS. 5 and 6, the mat portion 16 comprises one or more panels of material that define a rectangular shape having a width substantially equal to the width of the cylindrical pocket 12, and a length at least equal to a distance between the back of the head to the seat of a person of average height. Preferably, the mat portion 16 is of sufficient length to extend beyond the feet of a person of average height when such person is reclined on the device 10 such that his or her head rests on the cylindrical pocket 12. Thus, for example, the mat portion 16 may be about between 3 ft.-8 ft. or 4, 5, 6 or 7 feet in length.

Figure 2:
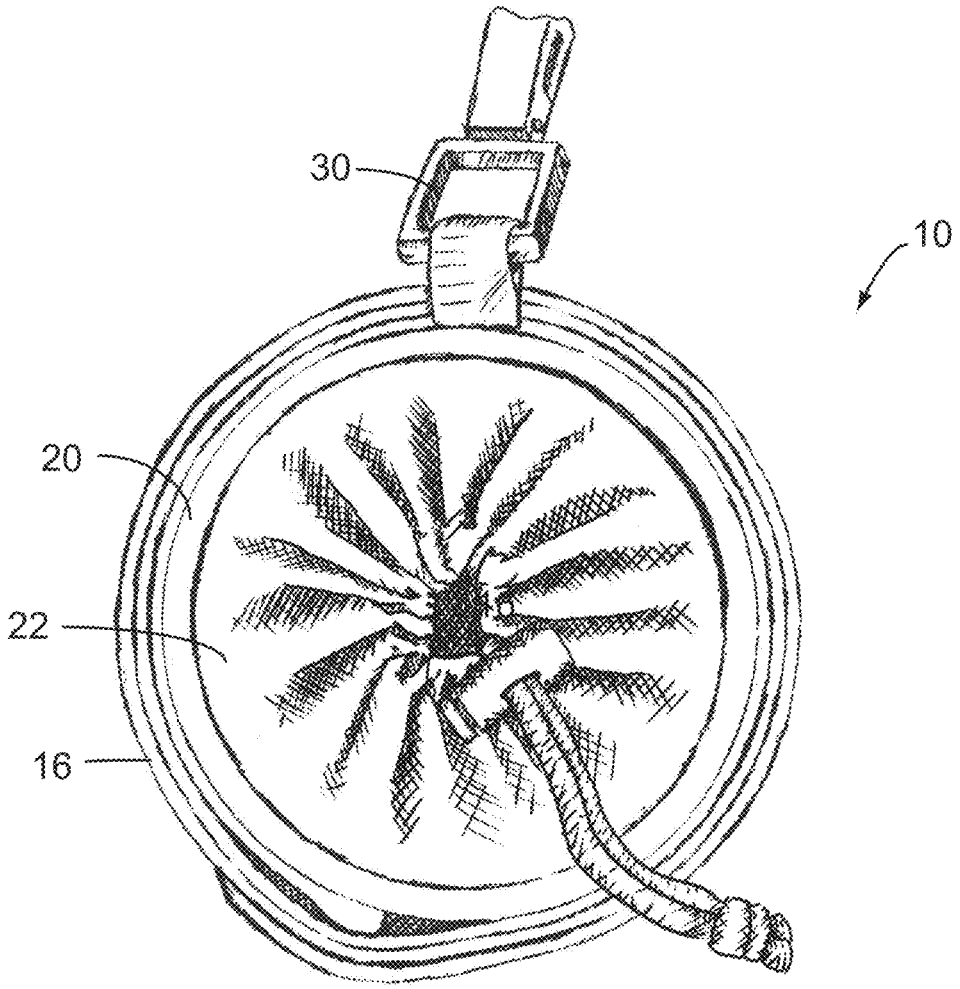
FIG. 2 is a left side view of the embodiment in FIG. 1.
Figure 3:
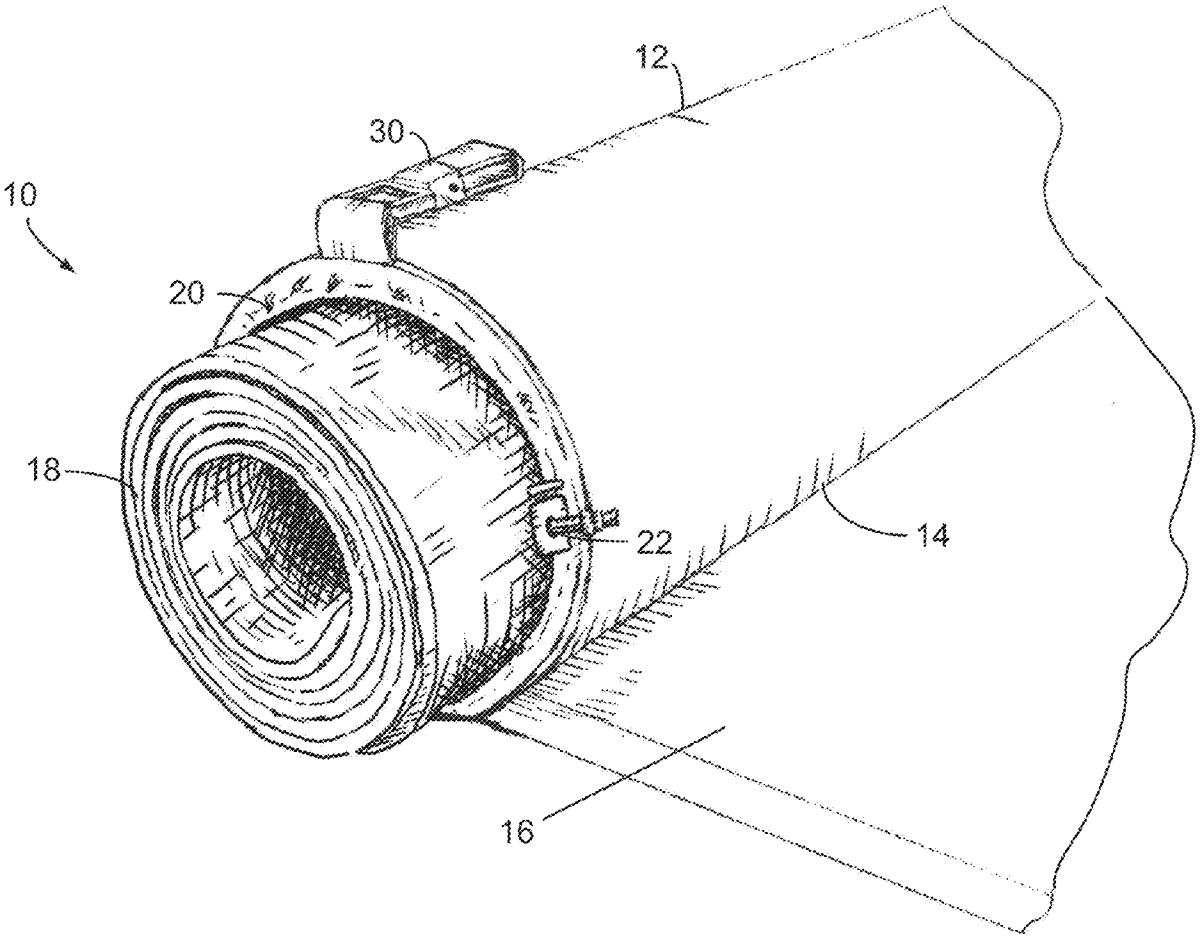
FIG. 3 is a left perspective view of the embodiment in FIG. 1.
Figure 4:
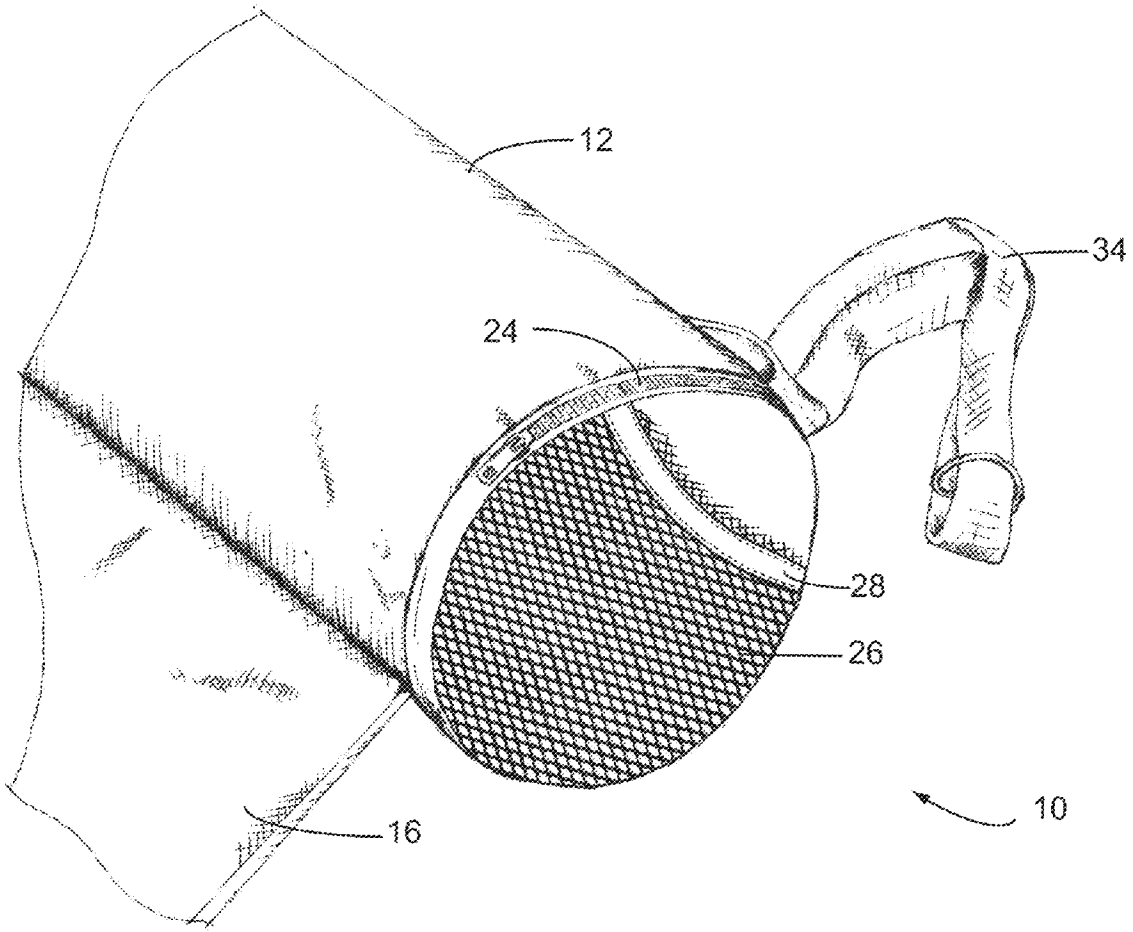
FIG. 4 is a right perspective view of the embodiment in FIG. 1.

The inside surface 38 toward the terminal end 40 of the mat portion 16 is provided with a plurality of male button snap fasteners 42 that align with complementary female button snap fasteners 45 provided on a button flap 46 the bottom or outer surface 44 of the mat portion 16 (see FIG. 1) when the mat portion 16 is rolled onto the cylindrical pocket 12, as in the rolled configuration of the device 10 shown in FIG. 2. Thus, the snap button fasteners 42 and 45 retain the device 10 in a rolled configuration, and a user unsnaps them to allow the device 10 to be unrolled. Button snap fasteners secure the beach mat when rolled up. The button snap fasteners are an easier and more secure way compared to buttons and slits, which will break down and stretch with usage. The snap button fasteners provide a tightly rolled beach mat device 10. Velcro could also be used as an alternative.

The terminal end 40 preferably also includes truncated diagonal corners 41 to allow for a tight and seamless tuck while secured as the diagonal corners 41 slide easily under the button flap 46 to secure efficiently for a tight secure fit and easy closure.

Figure 7:
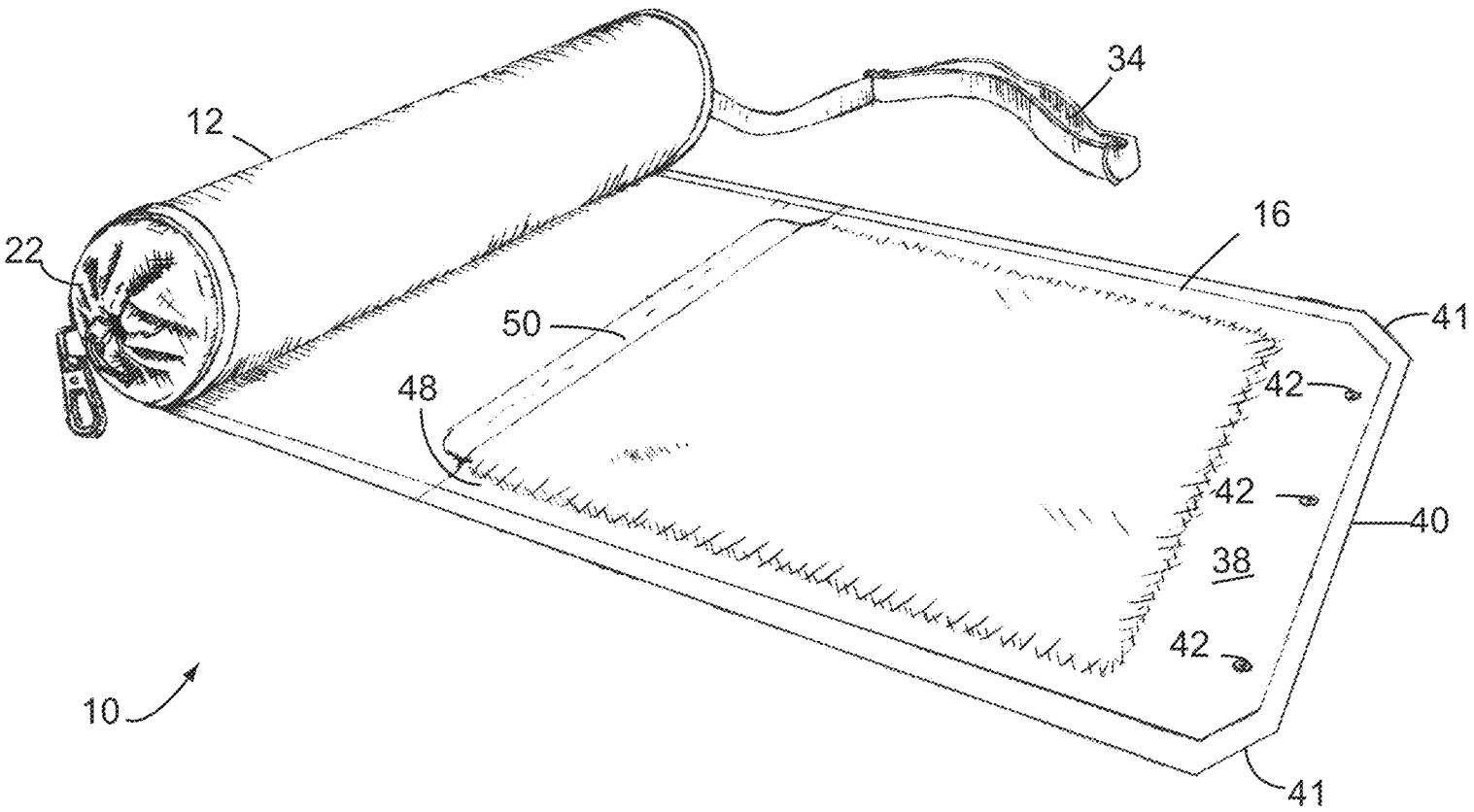
FIG. 7 is a left perspective view of combination beach mat and exercise mat carrying bag according to another embodiment of the invention shown partially unrolled.
Figure 8:
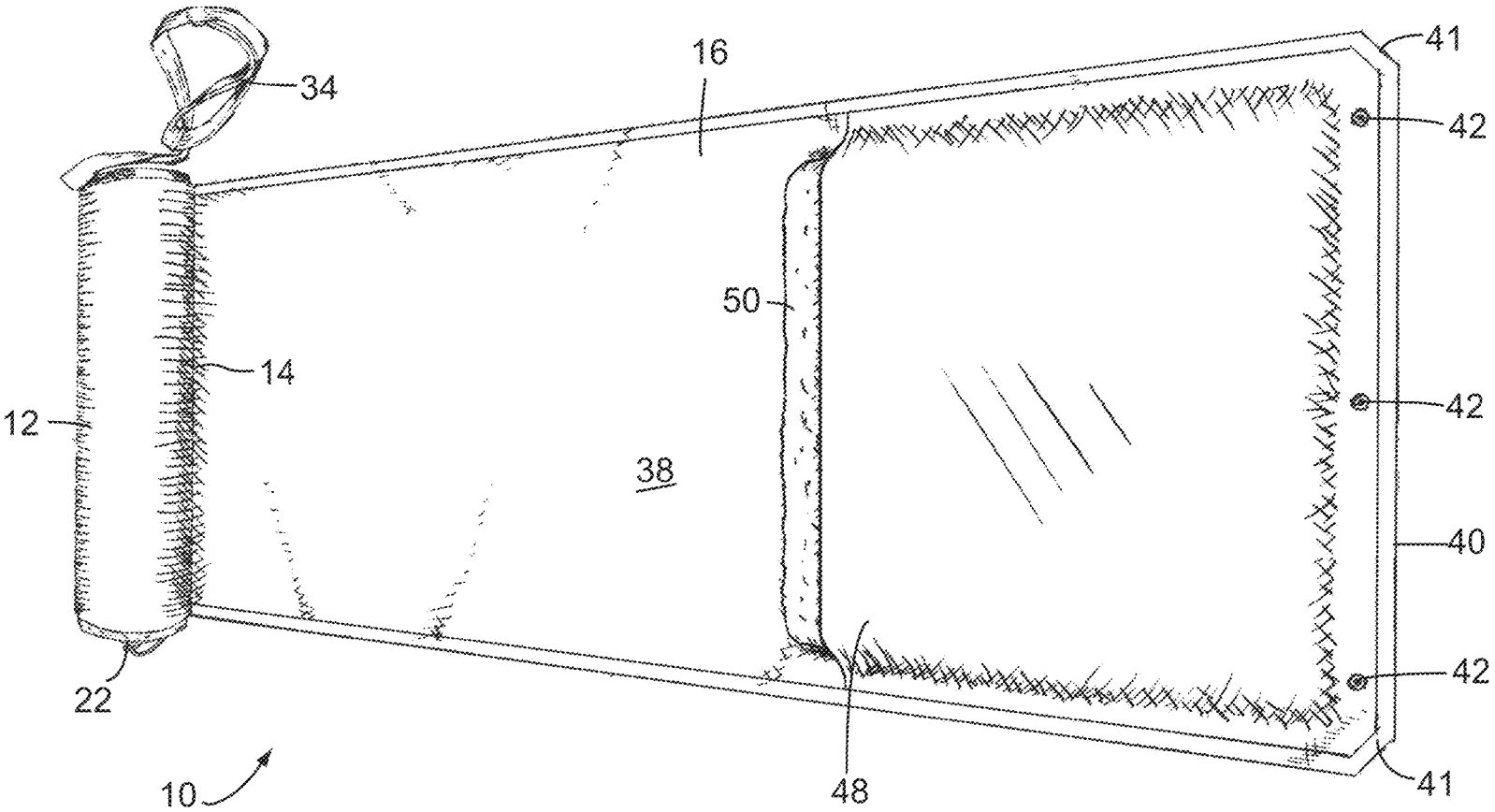
FIG. 8 is a top perspective view of the embodiment in FIG. 7 shown completely unrolled.

Referring to FIGS. 7 and 8, another embodiment of the present invention which includes a pocket 48 on the inside surface 38 on the mat portion 16, towards the terminal end 40. The pocket 48 is configured to receive a folded towel 50 therein for convenient storage of same as well as to provide a cushioned area on the mat portion 16 that may be used as a seat cushion. Instead of a towel 50, one may use a planar foam cushion with the pocket 48.

Referring to FIGS. 10-18, a combination beach mat and exercise mat carrying bag according to another embodiment of the invention is shown generally at 100. The device 100 includes a cylindrical pocket member or pocket 112 that is attached along a longitudinal edge 114 to an elongate fabric member such as mat portion 116.

The pocket 112 is configured to receive within its cavity a rolled up exercise mat 18, such as a yoga mat. Alternatively, a tubular foam bolster as mentioned above may be used in place of a rolled up exercise mat for provided a cushion to the pocket 112. Accordingly, the cylindrical pocket 112 and an exercise mat 18 or foam bolster received within it provides a head or neck support to a user who reclines on the device.

Preferably, the mat portion 116 is made of a fabric material, and preferably a material that is comfortable, durable, and water resistant. For example, Cordura™ fabric Denier 1000 having a rubberized bottom surface for abrasion resistance and durability as used for downward facing side of the mat when unrolled.

The pocket member 112 is made of a thin walled cylindrical foam tube within a fabric overlay. Alternatively, just the pocket may comprise of the foam tube alone. The foam tube maintains the shape of the pocket member 112, such that it is shape retaining resilient—i.e. the pocket member yields to deformation upon an application of force but returns to its cylindrical shape in the absence of the force. The pocket member 112 thus maintains its cylindrical shape when it is empty, which eases the insertion of an exercise mat 18 or foam bolster into the pocket 112. An example of the dimensions of the pocket member 112 include a length of approximately 26 inches and an inside diameter of approximately 5 inches. The material is approximately ⅜" thick and of a foam having approximate density of 2 lbs/cubic ft. These dimensions accommodate the typical rolled up exercise mat. Other suitable materials and construction methods may be used that provide shape retaining resilience.

At an open end of the pocket 112 is provided a zippered closure 122 that is configured to completely close off the open end for the purpose of retaining an exercise mat 18 within when the pocket is in a closed configuration, and to completely open to the circumference of the cylindrical pocket to allow the insertion and withdrawal of an exercise mat 18 or a foam bolster. The zippered closure 122 securely stores items inside the cavity of the pocket member 112 even if the device is held vertically while being carried. While in the illustrated embodiment a zipper is shown as a releasable fastening member, other releasable fasteners may be used, such as for example hook and loop type fasteners, as well as others know in the art.

The opposite end of the cylindrical pocket 112 is a closed end with a circular end panel of fabric (not shown). A zippered accessory pocket 124 is provided at the closed end for storage of keys, phone, wallets and other small items. The zippered pocket 124 may be configured to face open side upwards when the device 100 is unrolled and rolled up in carrying position.

The pocket 112 also includes a releasable buckle 130 anchored near the open end to which is attached an adjustable shoulder strap 134. The other end of the shoulder strap is anchored to the opposite end of the pocket adjacent the zippered pocket 124. Hence the end of the shoulder strap 134 adjacent the buckle 130 may be released from the device 100. The adjustable and detachable carrying strap gives a wider base and distributes the bag in a more balanced way that allows for multiple comfortable carrying positions, compared to carrying straps that are attached at narrower angle, and it can be easily adjusted for comfort.

Figure 15:
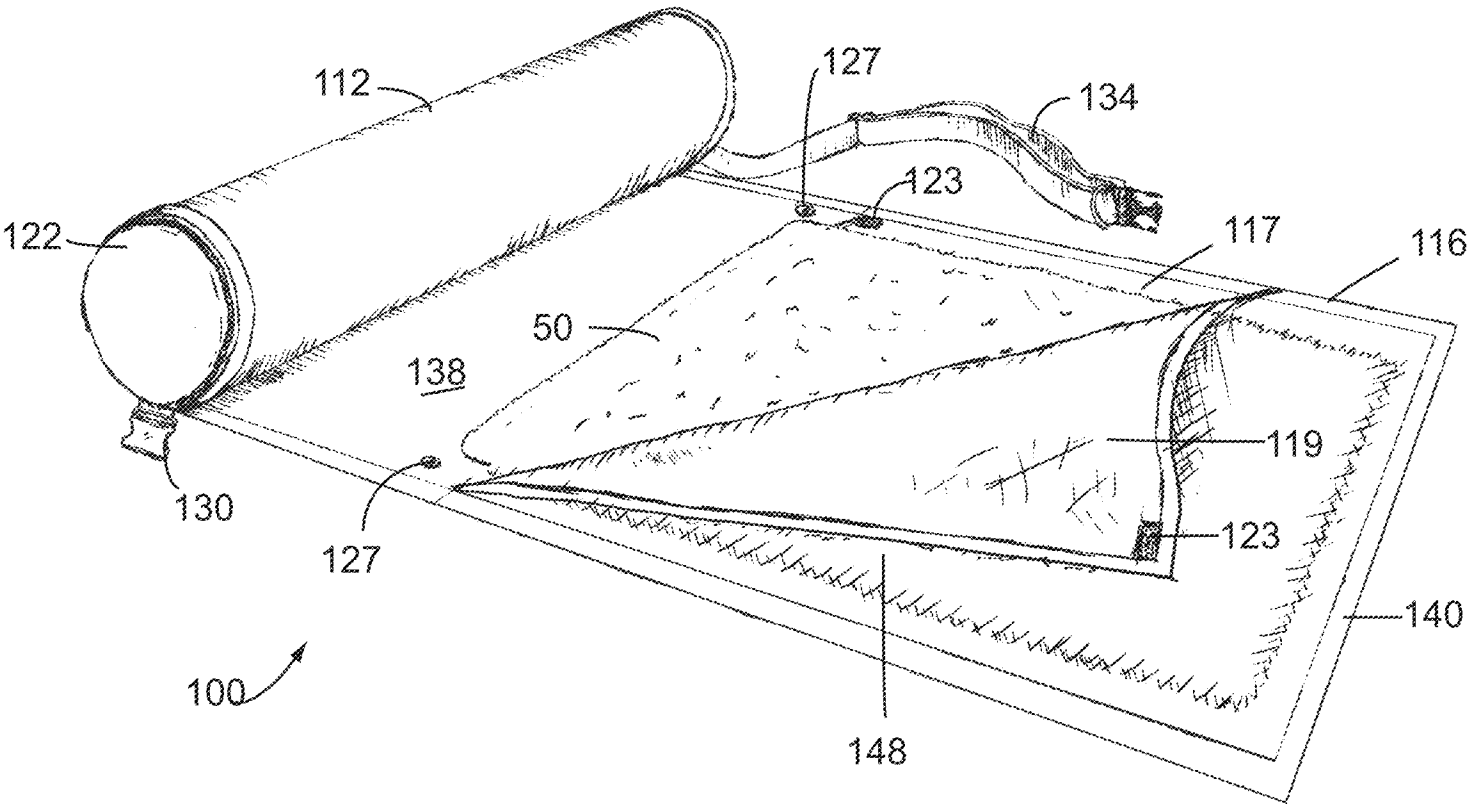
FIG. 15 is a left perspective view of the embodiment in FIG. 10 shown partially unrolled.
Figure 16:
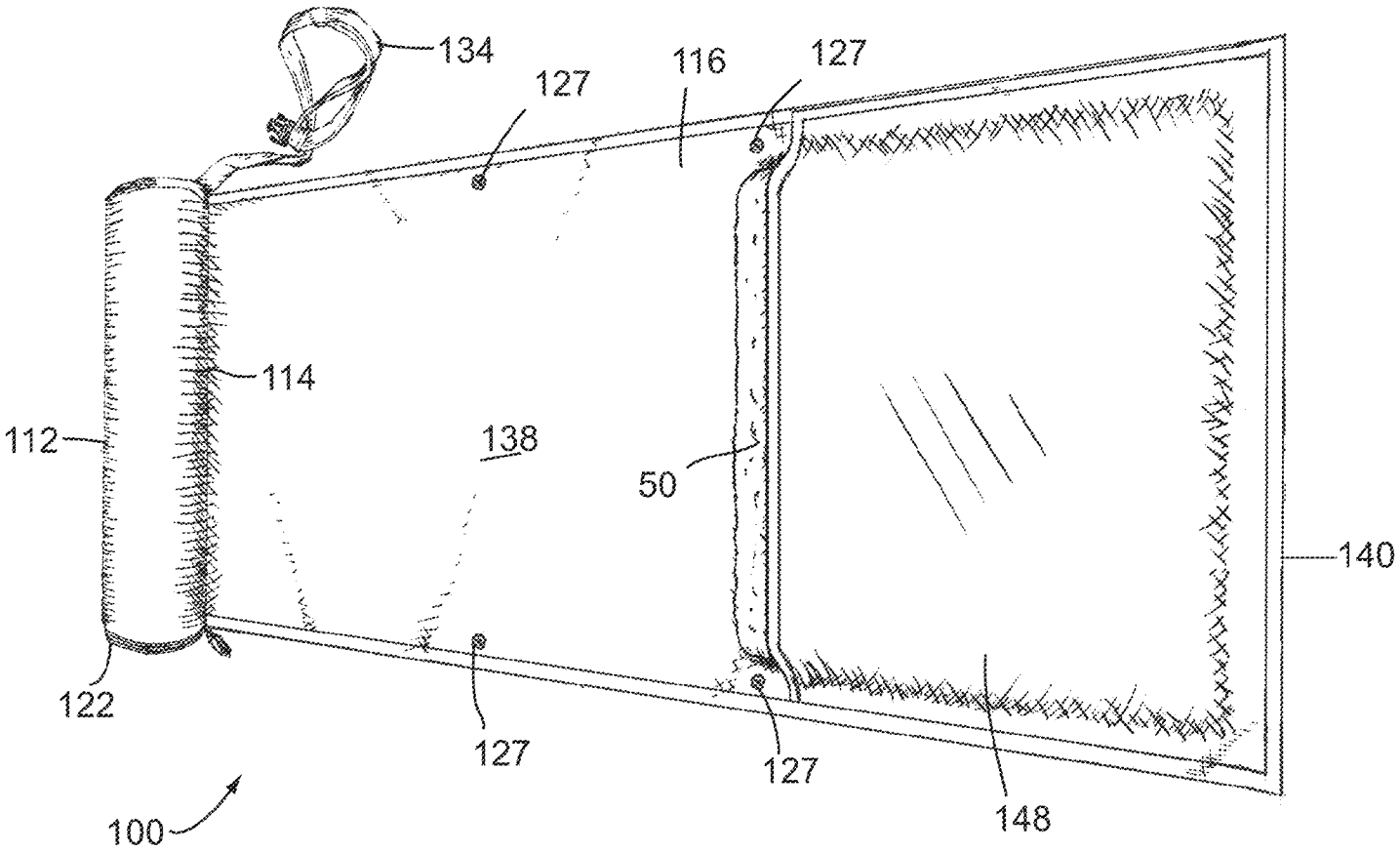
FIG. 16 is a top perspective view of the embodiment in FIG. 10 shown completely unrolled.

Referring to FIGS. 15 and 16, the mat portion 16 comprises one or more panels of material that define a rectangular shape having a width substantially equal to the width of the cylindrical pocket 112, and a length at least equal to a distance between the back of the head to the seat of a person of average height. Preferably, the mat portion 116 is of sufficient length to extend beyond the feet of a person of average height when such person is reclined on the device 100 such that his or her head rests on the cylindrical pocket 112. Thus, for example, the mat portion 116 may be about between 3 ft.-8 ft. or 4, 5, 6 or 7 feet in length.

Figure 17:
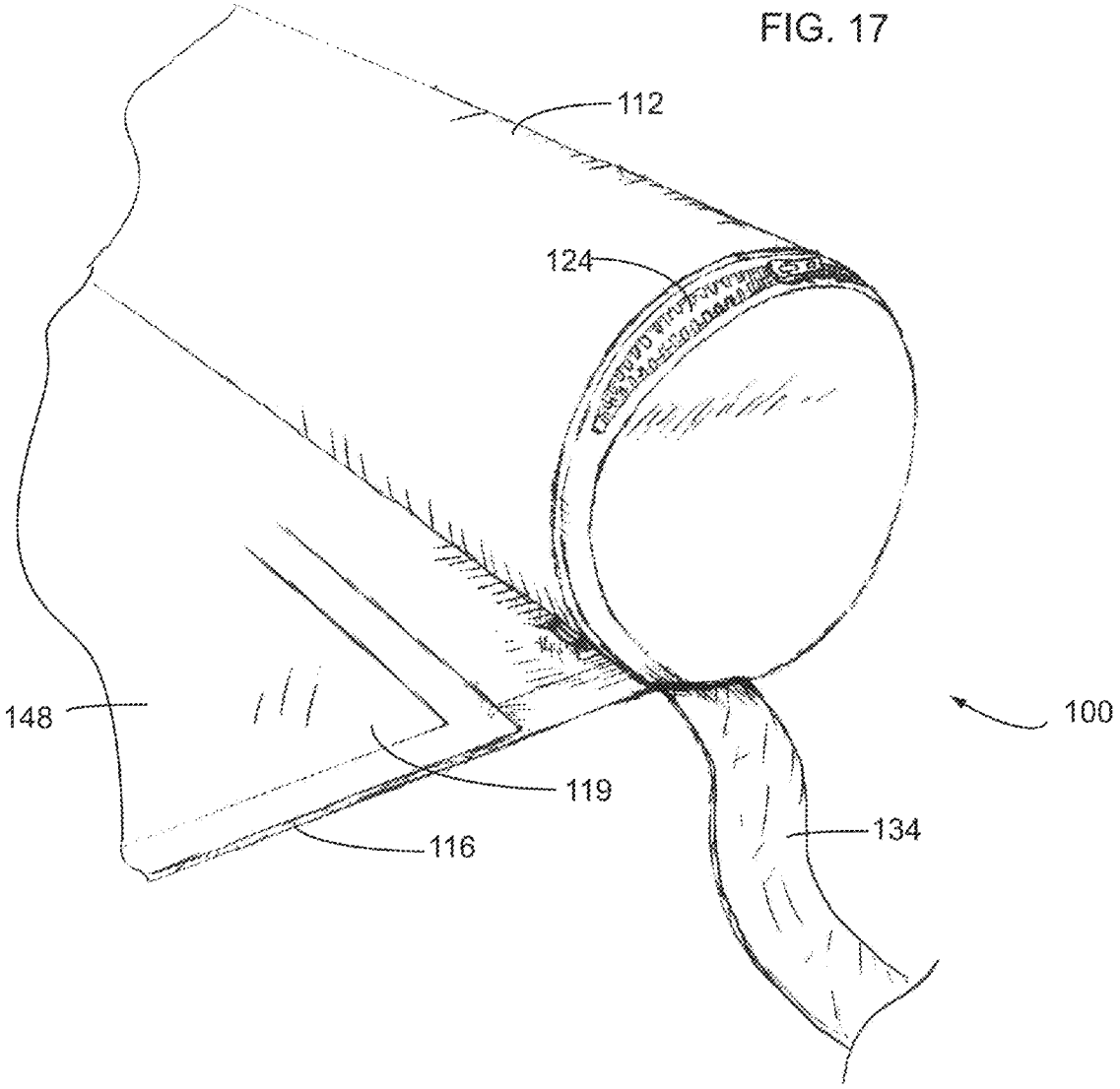
FIG. 17 is a right perspective view of the embodiment in FIG. 10.
Figure 18:
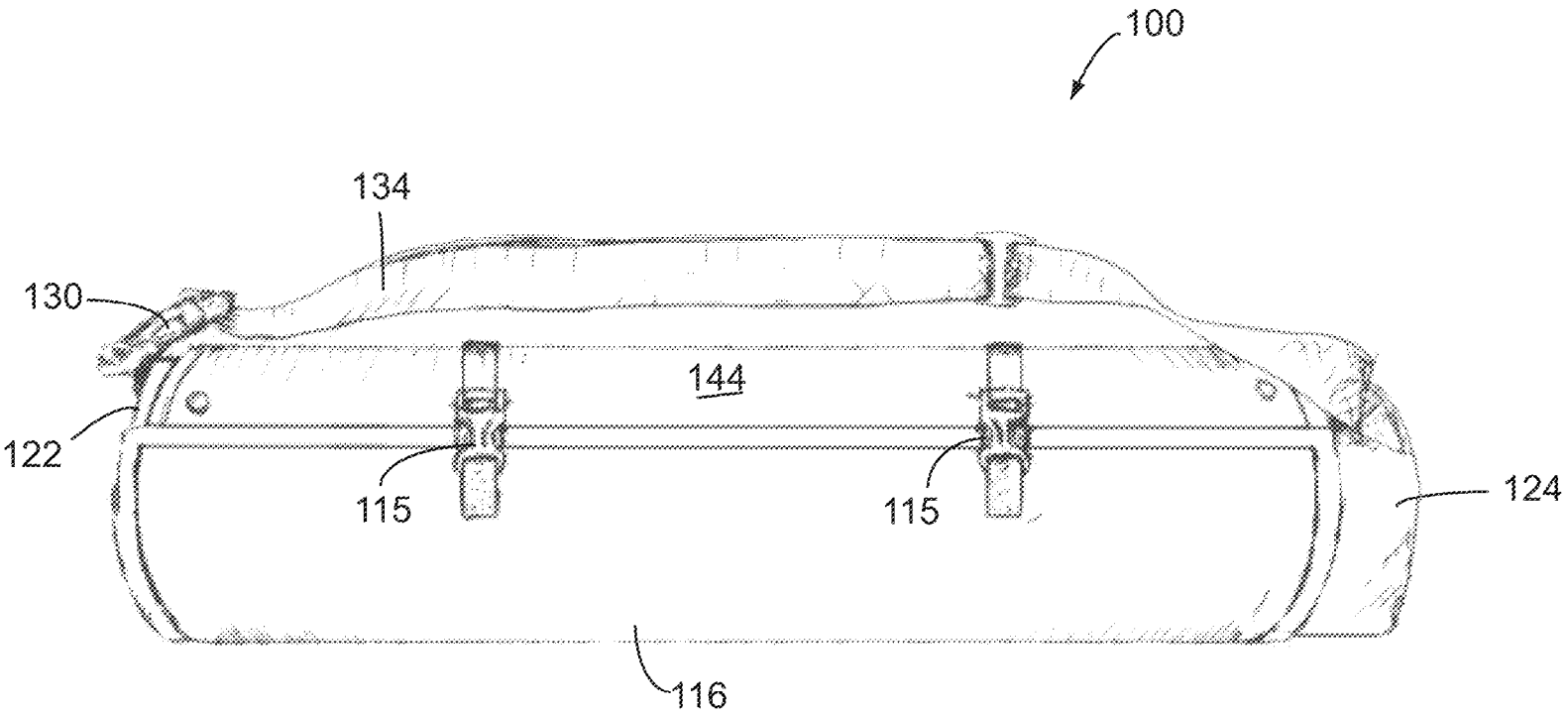
FIG. 18 is a front view of the embodiment in FIG. 10.

Referring to FIGS. 15-17, the mat portion 116 includes a pocket 148 on the inside surface 138 towards the terminal end 140. The pocket 148 is configured to receive a folded towel 50 therein for convenient storage of same as well as to provide a cushioned area on the mat portion 116 that may be used as a seat cushion. Instead of a towel 50, one may use a planar foam cushion with the pocket 148. The pocket 148 is has an open seam along one edge of the mat 117 to enable a pocket flap 119 to be opened for easier access to the pocket. Hook and loop fasteners 123 (such as Velcro™) in a top corners of the pocket 148 and flap 119 secures the flap against the mat 116. The towel pocket flap seam along edge 117 is not open to all the way to the terminal end of mat as this provides another secure pocket when rolled and carried vertically as items will not slide out the bottom. Preferably the towel pocket is the length of one full circumference of the cylinder pocket to maintain the cylindrical shape when rolled up and storing a folded towel. Also included are snap button stops 127 that are configured for partial unrolling of the mat to gain access to towel pocket, when for example, a user wants access to the pocket 148 but not wanting to unroll the mat completely.

A releasable fastening means such as two plastic side release buckles 115 with adjustable straps are provided anchored near the terminal edge 140 and to a corresponding location on the bottom surface 144 of the mat portion 116, when the mat is rolled onto the pocket with the top surface to the inside, to secure the device in the rolled configuration. The adjustable straps allow for expansion when storing towel as described herein.

Figure 19:
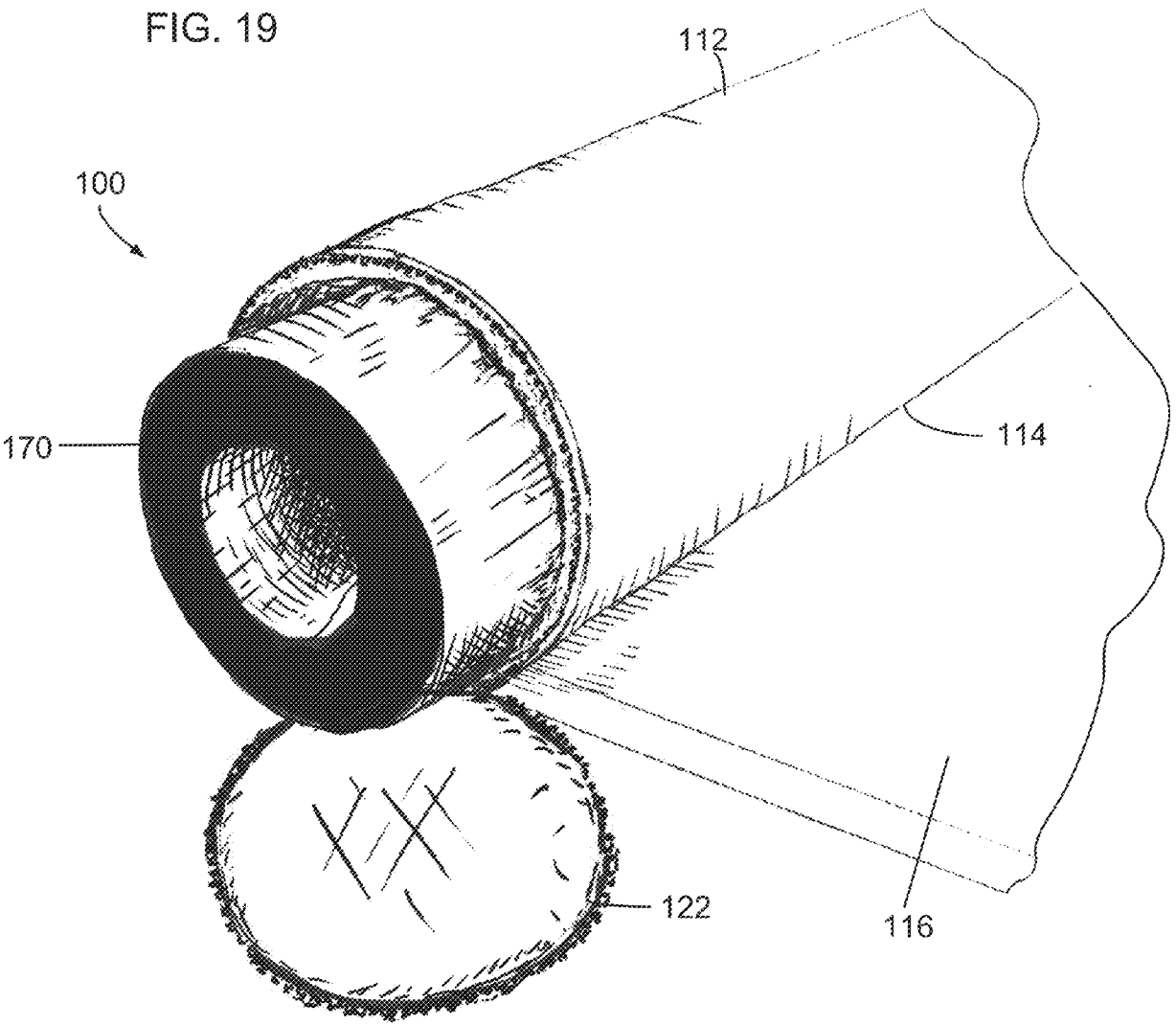
FIG. 19 is a left perspective view of the embodiment in FIG. 10 shown with a foam tubular.

Referring to FIG. 19, an accessory tube insert 170 is shown that may be placed within the pocket member as a thermal beverage insulator that also doubles as a head rest. The accessory tube insert 170 comprises a thick walled foam tube having an inside cavity with a diameter approximating typical cold beverage containers so that the tube insert 170 can hold bottles or cans whereby the foam tube acts as an insulator for cold beverages. The tube insert 170 may include a slit running the length of the tube to allow for expansion when used as beverage storage and for compression and comfort when empty and being used as head rest.

Figure 20:
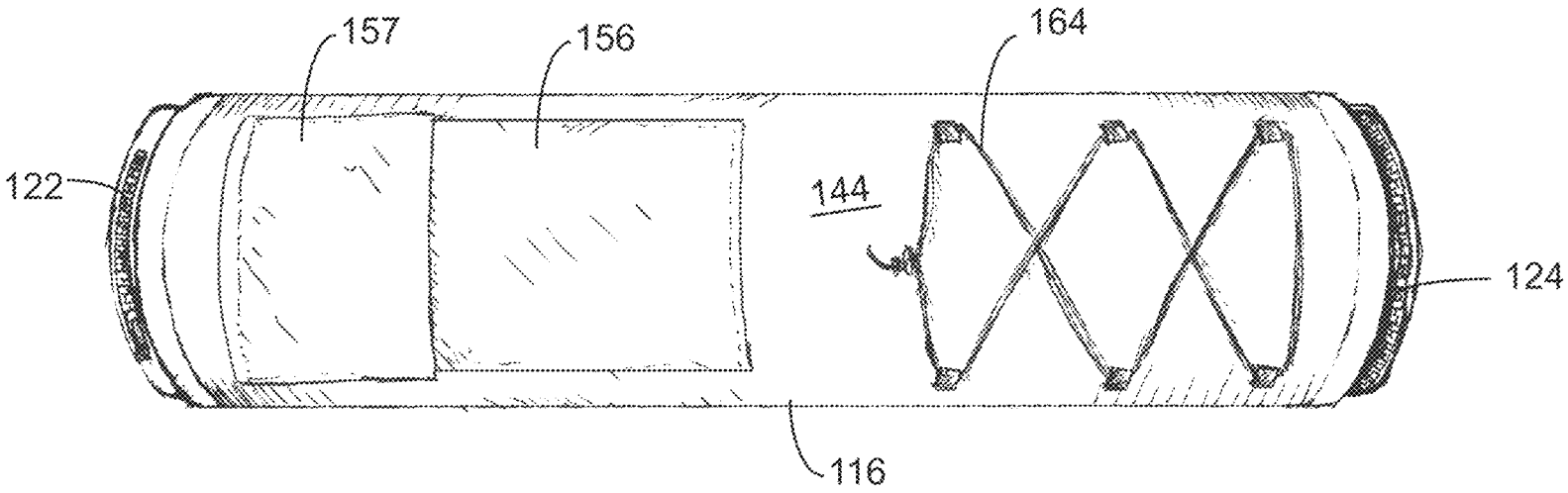
FIG. 20 is a top view of a combination beach mat and exercise mat carrying bag according to another embodiment of the invention.

Referring to FIG. 20, some additional features are shown that may be employed separately or in combination with other features in variants of the present invention. There is shown a large expandable front pocket 156 with a flap 157 and Velcro™ closure and an expandable folding seam to allow various sized items to be stored, such as a cell phone, tablet, water bottle, sunscreen bottle, book or sunglass case. When empty, the pocket 156 folds and secures with a low profile. Also shown is a draw string front pocket 164 used for quick and easy access and securing of loosely stored items on outside of bag. Usually a rolled up clothing item or towel.

The features described may be combined in various combinations in some embodiments of the present invention. For example, the inside pockets (48 or 148) may be used in some embodiments or omitted in others, and either may be combined with the snap fasteners 42 or used with the side buckles 115. Likewise, the drawstring closure 22 or the zippered closure 122 may be combined with other features such as the pocket 157 or 164, or pocket 124, and the like. Other combinations will be apparent to a person skilled in the art from the teaching herein.

It is understood that the embodiments described and illustrated herein are merely illustrative of embodiments of the present invention. Other embodiments that would occur to those skilled in the art are contemplated within the scope of the present invention. The invention may include variants not described or illustrated herein in detail. Thus, the embodiments described and illustrated herein should not be considered to limit the invention as construed in accordance with the accompanying claims.

What is claimed is:

1. A combination beach mat and exercise mat carrying bag comprising:

a cylindrical fabric pocket member having a closed end and an open end, and defining an outer surface and a cylindrical cavity adapted to receive an exercise mat in a rolled configuration, the open end of the pocket member having a movable closure panel to selectively enclose the cavity and a releasable fastening member cooperating with the open end and the closure panel to releasably secure the closure panel to the open end of the pocket member;

an elongate fabric member having opposing first and second ends, opposing sides, and a top and bottom surface, the first end of the fabric member being integrally connected to the pocket member along a longitudinal edge of the outer surface, wherein the fabric member may be rolled around the pocket member to provide a cylindrical compact configuration;

a thin foam cylinder secured within the cavity of the pocket member to provide shape retaining resilience such that the pocket member and foam cylinder combination yields to deformation upon an application of force but returns to a cylindrical shape in the absence of the force;

a fastening means situated at the second end of the fabric member and on a corresponding portion of the bottom surface when in the compact configuration to releasably secure the second end to the bottom surface for maintaining the carrying bag in the compact configuration; and a carrying strap affixed to each end of the pocket member allowing the carrying bag to be easily transported.

2. The apparatus as claimed in claim 1 wherein the fabric member comprises one or more panels of material that define a rectangular shape having a width substantially equal to the width of the pocket member, and a length of about between 3 ft.-8 ft.

3. The apparatus as claimed in claim 1 wherein the fabric member further includes on the top surface a planar second pocket extending substantially across a width of the fabric member and configured to receive a folded towel or cloth therein.

4. The apparatus as claimed in claim 3 wherein the second pocket is situated adjacent the second end of the fabric member.

5. The apparatus as claimed in claim 1 wherein the fastening means comprises a plurality of button snap fasteners on the top surface adjacent the second end and at complementary locations on the bottom surface.

6. The apparatus as claimed in claim 1 wherein the fastening means comprises a plurality of side release buckles adjacent the second end and at complementary locations on the bottom surface.

7. The apparatus as claimed in claim 1 further including a closeable third pocket at the closed end of the pocket member and sized to correspond with a circumference of the pocket member at the closed end.

8. The apparatus as claimed in claim 1 further including a closeable fourth pocket on the bottom surface sufficiently proximate to the second end such that the fourth pocket remains exposed with the fabric member being rolled onto the pocket member.

9. The apparatus as claimed in claim 1 where the releasable fastening member is a zipper on a circumference of the closure member and a corresponding edge on the open end of the pocket member.

10. The apparatus as claimed in claim 1 further including a removable foam insert within the thin foam cylinder.

11. The apparatus as claimed in claim 10 wherein the foam insert defines a longitudinal cavity sized to receive one or more beverage containers therein to thermally insulate the one or more beverage containers from the atmosphere.

12. The apparatus as claimed in claim 11 further including a closeable third pocket at the closed end of the pocket member and sized to correspond with a circumference of the pocket member at the closed end.

13. The apparatus as claimed in claim 11 further including a closeable fourth pocket on the bottom surface sufficiently proximate to the second end such that the fourth pocket remains exposed with the fabric member being rolled onto the pocket member.

* * * * *